US006546863B2

(12) United States Patent
Schaum et al.

(10) Patent No.: US 6,546,863 B2
(45) Date of Patent: Apr. 15, 2003

(54) MACHINE FOR PROCESSING PRINTING-MATERIAL SHEETS

(75) Inventors: Frank Schaum, Neckargemünd (DE); Lothar Stein, Hirschberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 1 day.

(21) Appl. No.: 09/859,792

(22) Filed: May 17, 2001

(65) Prior Publication Data

US 2001/0045167 A1 Nov. 29, 2001

(30) Foreign Application Priority Data

May 17, 2000 (DE) ..... 100 23 941

(51) Int. Cl.[7] ..... B41F 13/24

(52) U.S. Cl. ..... 101/248; 101/232; 101/183

(58) Field of Search ..... 101/248, 232, 101/183

(56) References Cited

U.S. PATENT DOCUMENTS

| | | | | | |
|---|---|---|---|---|---|
| 3,817,173 | A | * | 6/1974 | Merbold et al. | 101/248 |
| 4,553,478 | A | * | 11/1985 | Greiner et al. | 101/248 |
| 4,785,733 | A | * | 11/1988 | Hartung et al. | 101/248 |
| 4,821,640 | A | * | 4/1989 | Hajek et al. | 101/248 |
| 5,771,804 | A | * | 6/1998 | Knauer et al. | 101/183 |
| 5,918,542 | A | * | 7/1999 | Ruprecht | 101/226 |
| 5,970,866 | A | * | 10/1999 | Okawa | 101/232 |

FOREIGN PATENT DOCUMENTS

| | | |
|---|---|---|
| DE | 34 00 652 A1 | 7/1985 |
| DE | 40 13 003 C2 | 10/1991 |
| DE | 42 24 978 A1 | 2/1994 |
| DE | 295 05 822.6 U1 | 7/1995 |
| DE | 44 35 307 A1 | 4/1996 |
| DE | 197 20 741 A1 | 11/1998 |
| DE | 198 26 974 A1 | 12/1999 |
| WO | WO 91/16201 | 10/1991 |

OTHER PUBLICATIONS

"The Speedmaster 52 now lacquers inline" ["Die Speedmaster 52 lackiert jetzt inline"], Druck & Medien–Magazin Feb. 2000.

* cited by examiner

*Primary Examiner*—Anh T. N. Vo
*Assistant Examiner*—Manish S Shah
(74) *Attorney, Agent, or Firm*—Laurence A. Greenberg; Werner H. Stemer; Ralph E. Locher

(57) ABSTRACT

A printing-material sheet processing machine includes at least one processing unit with an impression cylinder and a tool-carrying cylinder bringable into contact with the impression cylinder, the tool-carrying cylinder having at least one tool selected from the group of tools consisting of respective deforming and separating tools for the printing-material sheets, the processing unit also having a circumferential-register adjusting device and a lateral-register adjusting device, which are assigned to the tool-carrying cylinder for adjusting the register thereof, and having a diagonal-register adjusting device assigned to a sheet transport cylinder for adjusting the register thereof, the sheet transport cylinder being disposed for transferring the printing-material sheets to the impression cylinder.

4 Claims, 3 Drawing Sheets

MACHINE FOR PROCESSING PRINTING-MATERIAL SHEETS

BACKGROUND OF THE INVENTION

The invention relates to a machine for processing printing-material sheets, which has a processing unit.

The published German Patent Document DE 4435307 A1 describes such a machine, the processing unit of which includes a printing form cylinder provided with devices for effecting circumferential and lateral register adjustment, and having a rotatable tool plate thereon. An inherent disadvantage of this machine, however, is that any correction of the oblique position of the tool plate on the form cylinder requires stopping the machine and carrying out the correction awkwardly by hand, by which assurance is provided that the cutting lines, creases, embossments, stampings or perforations which are produced in the processing unit are in-register with a printed image which is produced in a first printing unit following the processing unit.

In the publication "Druck & Medien" [Print and Media] magazine 2/2000, a printing machine manufactured by Heidelberger Druckmaschinen AG in the Speedmaster SM 52 series with a varnishing system is described, for which a lateral-register adjusting device, a circumferential-register adjusting device and a diagonal-register adjusting device are provided.

Although the register adjusting devices do, in fact, permit an absolutely in-register varnishing of the printing-material sheets, deforming or severing the printing-material sheets by appropriate processes in the varnishing system is not possible, however.

SUMMARY OF THE INVENTION

It is accordingly an object of the invention to provide a machine for processing printing-material sheets by which absolutely in-register processing of the printing-material sheets is assured.

With the foregoing and other objects in view, there is provided, in accordance with the invention, a printing-material sheet processing machine, comprising at least one processing unit with an impression cylinder and a tool-carrying cylinder bringable into contact with the impression cylinder, the tool-carrying cylinder having at least one tool selected from the group of tools consisting of respective deforming and separating tools for the printing-material sheets, the processing unit also having a circumferential-register adjusting device and a lateral-register adjusting device, which are assigned to the tool-carrying cylinder for adjusting the register thereof, and having a diagonal-register adjusting device assigned to a sheet transport cylinder for adjusting the register thereof, the sheet transport cylinder being disposed for transferring the printing-material sheets to the impression cylinder.

In accordance with another feature of the invention, the processing machine is a machine selected from the group consisting of a printing machine and a varnishing machine of modular in-line construction.

In accordance with a further feature of the invention, the tool for deforming the printing-material sheets is constructed as a tool selected from the group consisting of creasing, grooving and embossing tools.

In accordance with a concomitant feature of the invention, the tool for separating the printing-material sheets is constructed as a tool selected from the group consisting of cutting, stamping, scoring and perforating tools.

The printing-material sheet processing machine according to the invention thus includes at least one processing unit which has an impression cylinder and a tool-carrying cylinder. The tool-carrying cylinder can be brought into contact with the impression cylinder and brought out of contact with the latter again. In addition, the machine includes a lateral-register adjusting device assigned to the tool-carrying cylinder, a circumferential-register adjusting device likewise assigned to the tool-carrying cylinder, and a diagonal-register adjusting device. The diagonal-register adjusting device is assigned to a sheet transport cylinder, which is disposed immediately upline of the impression cylinder, as viewed in the transport direction of the printing-material sheets. On the circumference, the tool-carrying cylinder is equipped with at least one tool for deforming the printing-material sheets and/or with at least one tool for separating the printing-material sheets or with at least one tool for separating and deforming the printing-material sheets.

One advantage of the machine according to the invention is that an incorrect setting, for example a skewed position of the tool relative to the impression cylinder, can be corrected, under remote control while the machine is running, by the diagonal-register adjusting device, and is no longer required to be corrected by hand. By the diagonal-register adjusting device, the sheet transport cylinder can be adjusted into a skewed position in relation to the impression cylinder which corresponds to the skewed position of the tool, so that the printing-material sheets can be transferred skewed to the impression cylinder by the sheet transport cylinder. As a result of the skewed position of the printing-material sheets on the impression cylinder, the skewed position of the tool on the tool-carrying cylinder is compensated for, so that the processing lines or contours produced on the printing-material sheets by the tool are again absolutely in-register with reference or processing lines or printed images already located on the printing-material sheets or subsequently applied thereto.

Because the reference lines or reference printed images are preferably located on that side of the sheet whereon the tool also acts, the designations circumferential fit, lateral fit and diagonal fit adjusting device would intrinsically be more appropriate. However, in the description at hand, the designation register adjusting device, which is used in common parlance, will be used throughout for the adjusting devices.

If the tool disposed on the tool-carrying cylinder is constructed as a creasing tool, a grooving tool or an embossing tool, the tool is used for the partial deformation of the printing-material sheets. However, the tool can also be constructed as a separating tool for cutting, stamping, scoring or perforating the printing-material sheets. Of course, the tool-carrying cylinder can also carry the aforementioned tools in a multiple arrangement and in an arrangement combined with one another.

The printing-material sheet processing machine is preferably a printing or varnishing machine which, in a modular in-line construction, includes at least one printing unit and/or at least one varnishing unit in addition to the processing unit.

Other features which are considered as characteristic for the invention are set forth in the appended claims.

Although the invention is illustrated and described herein as embodied in a machine for processing printing-material sheets, it is nevertheless not intended to be limited to the details shown, since various modifications and structural changes may be made therein without departing from the spirit of the is invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
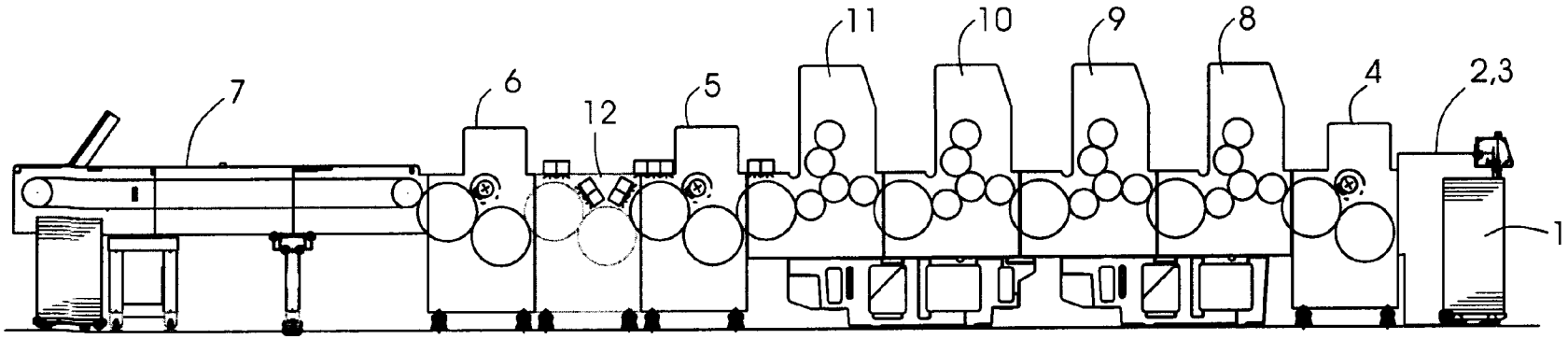
FIG. 1 is a diagrammatic side elevational view of a machine for processing printing-material sheets in accordance with the invention.

Referring now to the drawings and, first, particularly to FIG. 1 thereof, there is shown therein a processing machine 2 for printing-material sheets 1, which includes a sheet feeder 3, at least one processing unit 4, 5 and 6 and a sheet delivery 7. In the exemplary embodiment shown, the processing machine 2, having a modular in-line construction typical of rotary sheet-fed printing machines, in cludes, in addition to the units mentioned herein before, at least one printing unit 8 to 11, which is constructed as an offset printing unit and, differing from the exemplary embodiment shown, may also be constructed as a flexographic printing unit for printing a varnish or an ink. The in-line operated processing unit 4 is disposed upline of the first printing unit 8, and the processing units 5 and 6, between which a drying unit 12 is disposed, are arranged downline of the last printing unit 11 in the sheet transport direction from the feeder 1 to the delivery 7. Each of the units 4 to 6 and 8 to 12 has separate side walls, which are fitted together with those of the respective adjacent unit.

Figure 2:
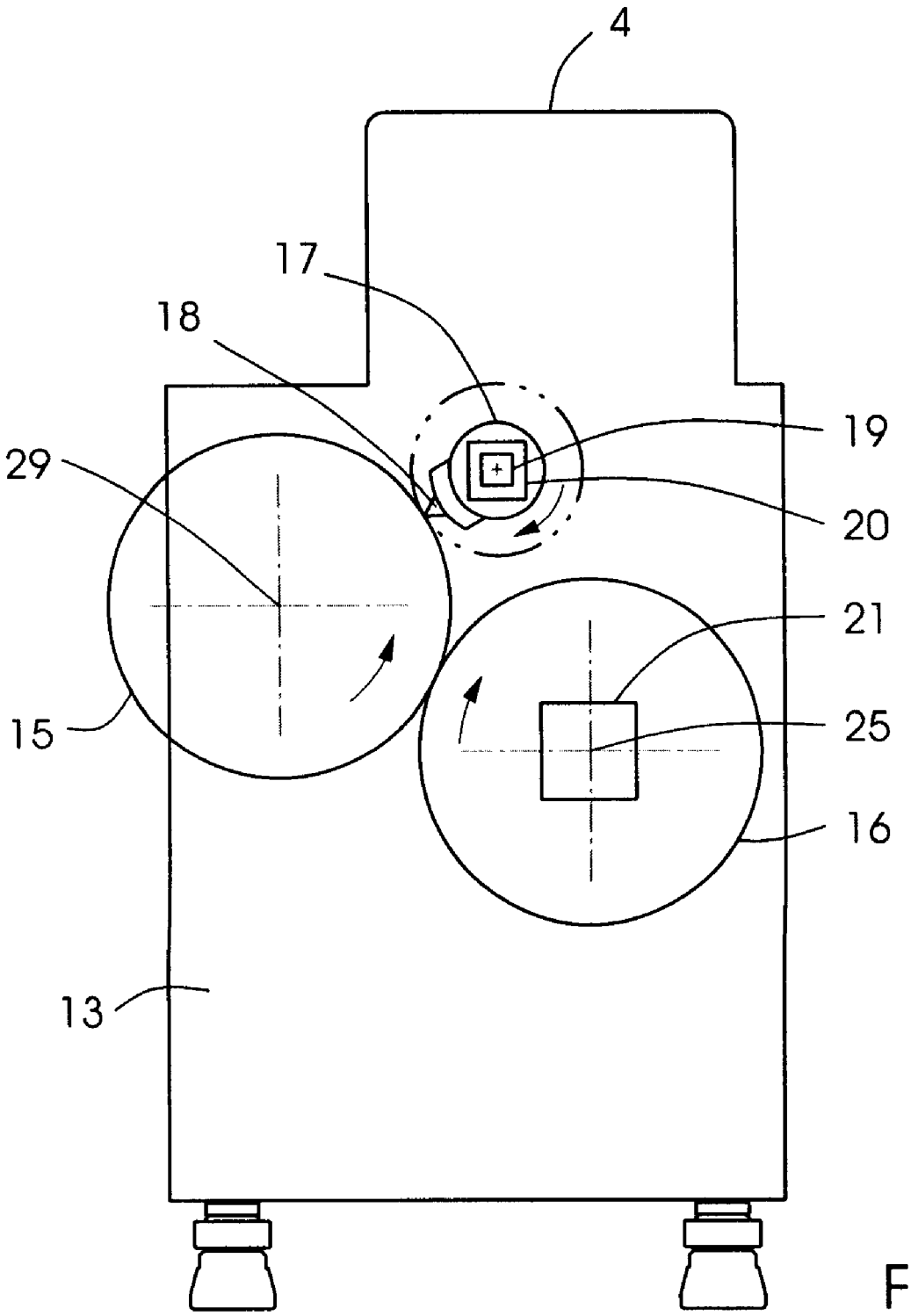
FIG. 2 is an enlarged fragmentary view of FIG. 1 showing a processing unit thereof.

The construction of each of the processing units 4 to 6 is explained hereinbelow with reference to FIGS. 2 and 3, using processing unit 4 as an example. The processing unit 4 has two side walls 13 and 14, between which a double-size impression cylinder 15, a double-size sheet transport cylinder 16 disposed upline therefrom, and a tool-carrying cylinder 17 are rotatably mounted. Each of the cylinders 15 and 16 is equipped with two non-illustrated gripper bars for holding the printing-material sheets 1.

The tool-carrying cylinder 17 is outfitted with at least one tool 18, which is constructed as a separating or parting tool and which is fixed on the tool-carrying cylinder 17 so as to be replaceable by a different tool, for example a deformation tool for partially deforming the printing-material sheets 1. The tool-carrying cylinder 17 is equipped with a register system, including register pins, which permits the tool 18 to be prealigned on the tool-carrying cylinder 17. In the case of a tool 18 in the form of at least one curved or straight line, a stamping line and, possibly, also a perforating line or an embossing line is involved. A circumferential-register adjusting device 19, a lateral-register adjusting device 20 and a diagonal-register adjusting device 21 belonging to the processing unit 4 are illustrated in very diagrammatic form in FIG. 2. The circumferential-register adjusting device 19 includes an obliquely toothed spur gear of the impression cylinder 15 and a likewise obliquely toothed spur gear meshing therewith and provided for the tool-carrying cylinder 17, as well as a remotely controllable actuating drive for displacing the spur gear of the tool-carrying cylinder 17 in an axially parallel direction relative to the spur gear of the impression cylinder 15. As a result of the displacement of the spur gear connected coaxially to the tool-carrying cylinder 17 so that it is rotatable therewith, in relation to the spur gear of the impression cylinder 15, which is held fixed in the assumed rotational position, the rotational angle, i.e., the circumferential register, of the tool-carrying cylinder 17 and therefore of the tool 18 relative to the impression cylinder 15 is adjusted.

The lateral-register adjusting device 20 includes a remotely controllable actuating drive for axially displacing the tool-carrying cylinder 17 and, with the latter, the tool 18 in relation to the impression cylinder 15, counter to the restoring action of a spring, and also includes a thrust link for guiding the axial displacement of the tool-carrying cylinder 17.

Figure 3:
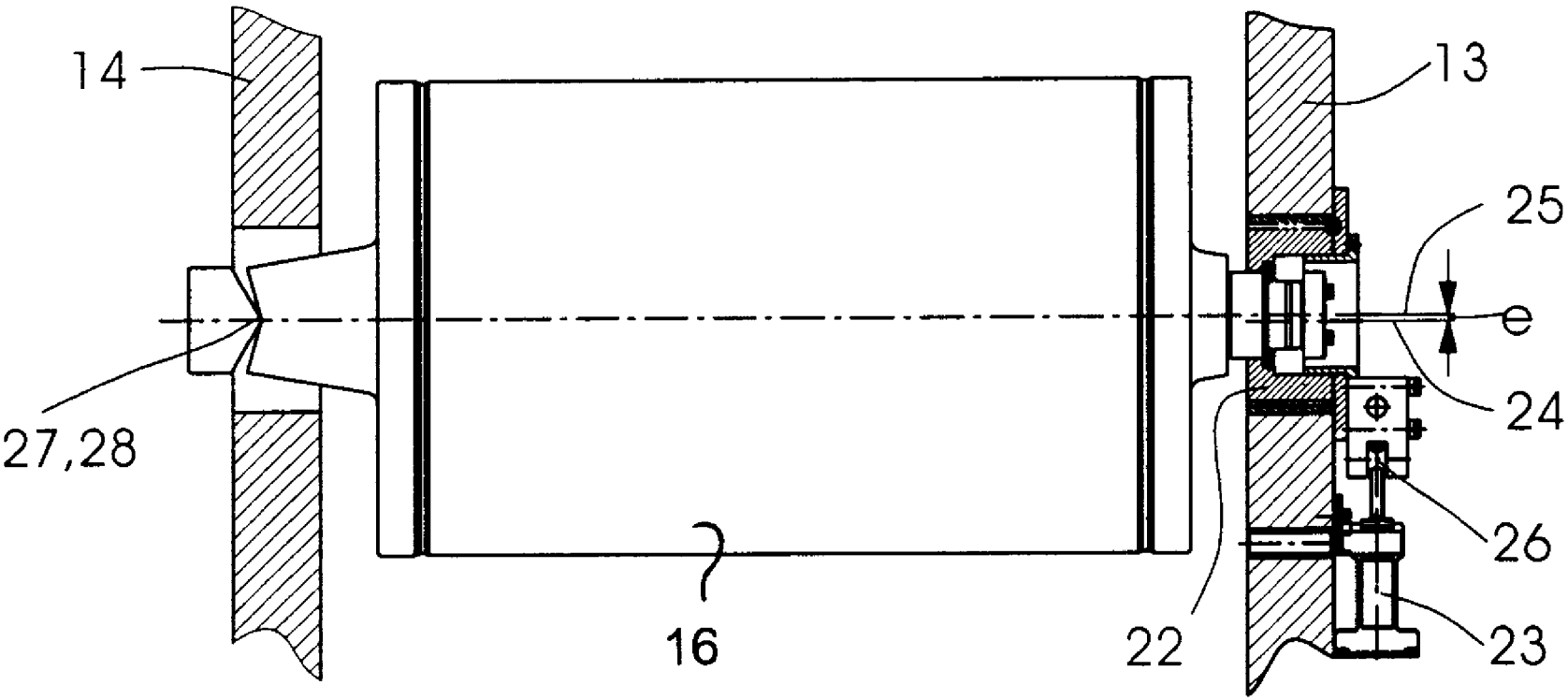
FIG. 3 is a fragmentary front elevational view, partly in section, of FIG. 2, showing a diagonal-register adjusting device of the processing unit.

The diagonal-register adjusting device 21 of the processing unit 4 is illustrated in detail in FIG. 3 and includes a bushing-type eccentric bearing 22, which is mounted in the side wall 13 so as to be rotatable about a middle axis 24 of the eccentric bearing 22 by a remotely controllable actuating drive 23 constructed as an electric motor. A shaft journal of the sheet transport cylinder 16 is mounted in the eccentric bearing 22 so as to be rotatable, and is eccentric relative to the middle axis 24. The eccentricity e between an axis of rotation 25 of the sheet transport cylinder 16 and the middle axis 24 is indicated in FIG. 3. A threaded spindle of the actuating drive 23, together with a threaded bushing disposed so as to be rotatable on the eccentric bearing 22, forms a screw mechanism 26, via which the actuating drive 23 transmits the drive movement thereof to the eccentric bearing 22. The actuating drive 23 is disposed on the side wall 13 so as to be rotatable, yet fixed to the frame.

The diagonal-register adjusting device 21 also includes a rotary bearing 27 disposed on the side of the tool-carrying cylinder 17 opposite the eccentric bearing 22 and having a pivot 28 located on the axis of rotation 25, the sheet transport cylinder 16 and the rotational axis 25 thereof being tiltable about the pivot 28, due to appropriate rotations of the eccentric bearing 22, into various oblique positions and also into the parallel position relative to the axis of rotation 29 of the impression cylinder 15. In order to clarify the principle, the rotary bearing 27 in FIG. 3 is illustrated as a special swing bearing. Because the angles between the axes 25 and 29 which correspond to the oblique positions are extremely small, no such swing bearing is required in practice, and, instead, the play of a roller bearing serving as the rotary bearing 27, wherein a shaft journal of the sheet transport cylinder 16 is rotatably mounted, can be utilized for predefining the pivot 28.

Each of the register adjusting devices 19 to 21 can be controlled from a control desk or console belonging to the machine and is readjusted by the operator, during the uninterrupted machine run, until the visually assessed register accuracy or the register accuracy registered by measurement, of the printing-material sheets delivered by the sheet delivery meets the requirements.

One advantage of the machine 2 resides in the fact that, if a tool 18, which is not aligned sufficiently accurately on the tool-carrying cylinder 17, or has previously been made-ready incorrectly, the incorrect setting thereof does not have to be corrected by dismantling and reassembling the tool 18; instead, it is merely necessary to take into account the incorrect setting of the tool 18 during the transfer of the printing-material sheets 1 from the sheet transport cylinder 16 to the impression cylinder 15. In other words, by an appropriately selected adjustment or setting of the diagonal-register adjusting device 21, each of the printing-material sheets 1 is transferred to the impression cylinder 15 in a specific skewed position relative to the tool-carrying cylinder 17 and to the impression cylinder 15 and is transported in this skewed position on the impression cylinder 15 past the rotating tool-carrying cylinder 17. The specific skewed position is set in or adjusted so that, in spite of inaccurate assembly or make-ready of the tool 18, a processing and stamping line, respectively, produced by the tool 18 is in an in-register condition relative to printed images produced in the printing units 8 to 11.

We claim:

1. A printing-material sheet processing machine, comprising at least one processing unit with an impression cylinder and a tool-carrying cylinder bringable into throw-on cooperation with said impression cylinder, said tool-carrying cylinder having at least one tool selected from the group of tools consisting of respective deforming and separating tools for the printing-material sheets, said processing unit also having a circumferential-register adjusting device and a lateral-register adjusting device, which are assigned to said tool-carrying cylinder for adjusting the register thereof, and having a diagonal-register adjusting device assigned to a sheet transport cylinder for adjusting the register thereof, said sheet transport cylinder being disposed for transferring the printing-material sheets to said impression cylinder.

2. The processing machine according to claim 1, which is a machine selected from the group consisting of a printing machine and a varnishing machine of modular unit construction.

3. The machine according to claim 1, wherein said tool for deforming the printing-material sheets is constructed as a tool selected from the group consisting of creasing, grooving and embossing tools.

4. The machine according to claim 1 or 2, wherein said tool for severing the printing-material sheets is constructed as a tool selected from the group consisting of cutting, stamping, scoring and perforating tools.

* * * * *